United States Patent [19]

Cheshire et al.

[11] Patent Number: 4,686,006

[45] Date of Patent: Aug. 11, 1987

[54] APPARATUS AND METHOD FOR THE MANUFACTURE OF FIBROUS WEBS

[75] Inventors: James O. Cheshire, Neenah; Robert J. Marinack, Oshkosh; Johannes A. Van den Akker; Douglas L. Lindgren, both of Appleton, all of Wis.

[73] Assignee: James River - Norwalk, Inc., Norwalk, Conn.

[21] Appl. No.: 827,281

[22] Filed: Feb. 6, 1986

Related U.S. Application Data

[63] Continuation of Ser. No. 600,679, Apr. 16, 1984, abandoned.

[51] Int. Cl.[4] ..... D21F 1/02

[52] U.S. Cl. ..... 162/336; 162/101; 162/338; 162/339; 162/343

[58] Field of Search ..... 162/101, 315, 322, 336, 162/343, 339, 380, 338

[56] References Cited

U.S. PATENT DOCUMENTS

| | | | |
|---|---|---|---|
| 2,481,959 | 9/1949 | Wahlin | 162/101 |
| 3,201,306 | 8/1965 | Hornbostel | 162/213 |
| 3,296,066 | 1/1967 | Green et al. | 162/343 |
| 3,798,122 | 3/1974 | Appel | 162/101 |
| 3,871,952 | 3/1975 | Robertson | 162/101 |
| 3,938,782 | 2/1976 | Robertson | 162/101 |
| 4,197,159 | 4/1980 | Newns et al. | 162/336 |
| 4,285,767 | 8/1981 | Page | 162/343 |

*Primary Examiner*—Peter Chin

*Attorney, Agent, or Firm*—William A. Aguele; Harry W. Hargis, III; Thomas H. Whaley

[57] ABSTRACT

Apparatus and method for laying down a fibrous web from a foam-fiber furnish. A headbox includes walls defining an elongate channel extending transversely of the direction of movement of the forming wire. Foam-forming nozzles are positioned to introduce foam-fiber furnish into the channel for turbulence - inducing impact on an oppositely disposed wall defining the channel. The turbulently flowing foam-fiber furnish is then introduced to the headbox slice for discharge onto the forming wire with minimized MD orientation of the fibers.

3 Claims, 7 Drawing Figures

APPARATUS AND METHOD FOR THE MANUFACTURE OF FIBROUS WEBS

This is a continuation of application Ser. No. 06/600,679, filed Apr. 16, 1984 now abandoned.

BACKGROUND OF THE INVENTION

This invention relates to the manufacture of fibrous webs, and especially to improvements in a method and apparatus for laying down a fibrous web from a foam-fiber furnish.

In the manufacture of fibrous webs, such as paper, from a foam-fiber furnish deposited on a forming wire from the slice of a conventional foam-forming headbox, it has been found difficult to maintain a desired random orientation of fibers ensuring optimum MD/CD tensile strength of the formed sheet at the preferred, relatively high wire speeds associated with papermaking. Efforts at achieving a desired fiber orientation have involved delivering the foam-fiber furnish to the slice, immediately upon creation of the furnish.

Apparatus and methods are found in the prior art for depositing foam-fiber furnishes on forming wires, immediately upon its formation, to achieve a range of MD/CD ratios. U.S. Pat. Nos. 3,798,122 and 3,837,999 are exemplary of prior art teaching of foam-fiber furnish deposition in the manufacture of fibrous webs of predetermined MD/CD ratios through control of fiber orientation. Of these patents:

U.S. Pat. No. 3,798,122 discloses a mechanical foam generator for a foamable liquid-fiber furnish, wherein the foamed furnish having an air content from about 56% to about 67% is immediately discharged from a mechanical foam generator through a slice onto a forming wire moving at speeds in a range of from about 300 to about 1500 feet per minute, in achievement of a desired random orientation of fibers in the formed web; and U.S. Pat. No. 3,837,999 discloses control of fiber orientation in a foam-fiber furnish, having an air content from about 65% to about 75%, by varying the wetted perimeter of a nozzle from which the foam furnish, immediately upon its formation in a mechanical generator, is discharged onto a forming wire moving at relatively low speed in a range of from about 90 to about 120 feet per minute.

U.S. Pat. No. 3,937,273 discloses foaming in a headbox per se by introduction of air into a foamable papermaking furnish in the headbox, to generate foam and create turbulence for preventing flocculation.

The following U.S. patents, while not concerned with foam-fiber furnishes, are exemplary of art relating to agitation of liquid-fiber furnish immediately prior to its deposition on a forming wire:

U.S. Pat. Nos. 3,954,558 and 4,021,296 disclose apparatus for feeding liquid-fiber furnishes, including convoluted turbulencegenerating headboxes; and U.S. Pat. Nos. 3,092,540, 3,846,230, and 3,201,306 disclose headbox apparatus provided with abutment portions against which fluid-fiber furnish is impacted to create turbulence.

Further art relating to papermaking from a foam-fiber furnish includes U.S. Pat. No. 3,938,782 that discloses feeding a mixture of air, surface active agent, fibers, and liquid through foaming nozzles that both foam the liquid and randomly orient the fibers. The foam-fiber furnish is, however, fed to the headbox channel through relatively long reaction tubes which disadvantageously tend to unidirectionally orient the fibers as they are presented for flow through the headbox slice and deposited on a forming wire.

While it will be appreciated that the present disclosure does have in common with the disclosure of the '782 patent a non-mechanical foam generator for a foam having a volume percentage of gas in the range of from about 55 to about 75 percent to achieve uniform dispersion of fibers in a foam-fiber furnish, the presently claimed invention has as a general objective, as an improvement over art exemplified by the '782 and the '122 patents in particular, the provision of the novel combination of a headbox with in-line foam generating nozzles for achieving random orientation of fibers in a foam-fiber furnish as it is deposited or spread by the headbox slice, at an efflux ratio (deposition speed/wire speed) of about 1.25, onto a forming wire moving from about 1500 to about 4000 feet per minute, to form a fibrous web having an improved MD/CD tensile strength ratio.

The present invention takes into account teaching based on fluid dynamics theory that fluid flow will be laminar or turbulent depending upon a value of the Reynolds number as defined by the following equation:

$$N_{Re}=\rho Vd/u$$

Where:

$N_{Re}$=the Reynolds number
$\rho$=fluid density
V=flow velocity
d=flow channel dimension
u=fluid viscosity For foam having the consistency and makeup contemplated by the present invention, and hereinbelow to be more fully described, a Reynolds number of 10,000 defines the point above which foam flow ceases to be laminar and becomes turbulent.

Since the foam has about one third the density of water, while having from about 10 to about 35 times the viscosity of water, it will be appreciated from the above equation that it is much more difficult to create turbulent flow of foam. Foam, however, exhibits pseudoplastic behavior, so that when it is subjected to shear of a sufficient rate, the apparent viscosity is reduced and its flow is most susceptible of becoming turbulent.

It will be appreciated from what follows that the present invention uses to maximum advantage this principle in the creation of turbulent flow of a foam-fiber furnish to obtain random fiber orientation.

SUMMARY OF THE INVENTION

In achievement of the foregoing as well as other objectives, the invention contemplates an improved apparatus and method for directing a foam-fiber furnish onto a forming wire in the manufacture of a fibrous web so that the fibers are randomly oriented. In its apparatus aspect, the invention contemplates provision of a headbox slice positioned to deposit said foam-fiber furnish onto said forming wire, wherein improvement resides in a headbox channel disposed in fluid flow communication with said slice, said channel extending generally transversely of the direction of movement of said forming wire, means defining an impact surface in said channel, and a plurality of foam-forming nozzles in fluid flow communication with said headbox channel and positioned and adapted to form and forcibly to direct foam-fiber furnish onto said surface, thereby to create turbulence immediately prior to flow of said foam-fiber furnish through said slice, ensuring random orientation of said fibers as they are deposited on said forming wire in formatiom of the web.

The manner in which objectives of the invention may best be achieved will be more fully understood from a consideration of the following description, taken in light of the accompanying drawing.

DETAILED DESCRIPTION OF THE SEVERAL EMBODIMENTS

Figure 1:
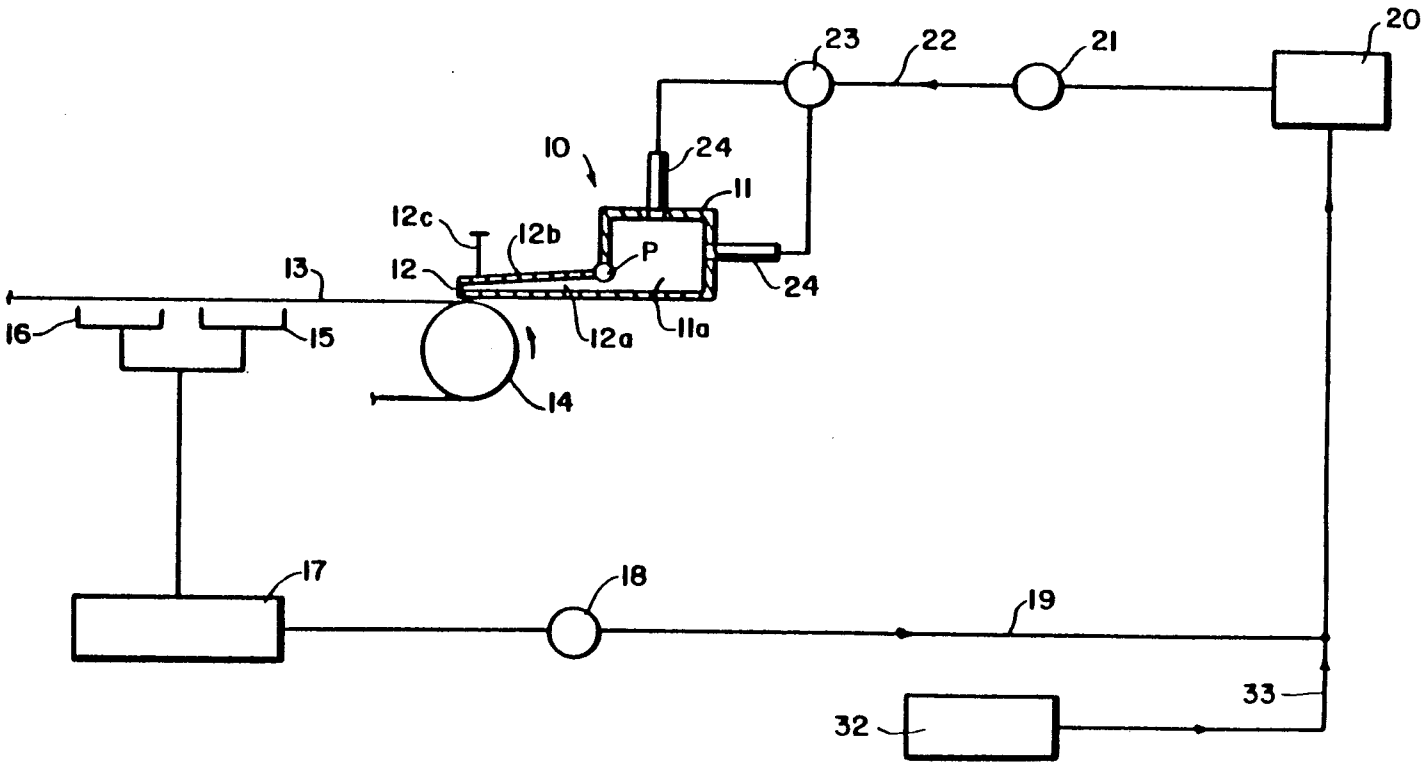
FIG. 1 is a diagrammatic showing of a web forming apparatus embodying the invention.

With more detailed reference to the drawing, there is seen in FIG. 1 a web forming apparatus 10 comprising a headbox 11 provided with a channel 11*a* leading to throat 12*a* of an adjustable slice 12 positioned and operative to discharge a foam-fiber furnish onto a forming wire 13 as it passes over a breast roll 14. Adjustment of the slice is afforded by a roof or upper wall 12*b* of throat 12*a* mounted for pivotal movement about hinge P, and positionable by a conventional jack means 12*c*. Suction boxes 15 and 16 are disposed beneath wire 13, and are connected to a vacuum source 17 for receiving both foam and liquid derived from collapsed foam, and drained through the wire. Drained foam and liquid are returned by a pump 18 through conduit 19 to an in-line mixer 20 for reuse, where additional fiber, either dry or as a dispersion, and air are introduced through pipe 33 to conduit 19, by means of a known metering device such as is seen at 32, to form a dispersion of air and fiber in water containing a surfactant in creation of a foamable furnish. From mixer 20, the foamable furnish is fed under pressure by a pump 21 through an input conduit 22 to a manifold 23. It will be understood that elements of the web forming apparatus thus far described are conventional, as exemplified by the referenced U.S. Pat. No. 3,938,782.

Figure 2:
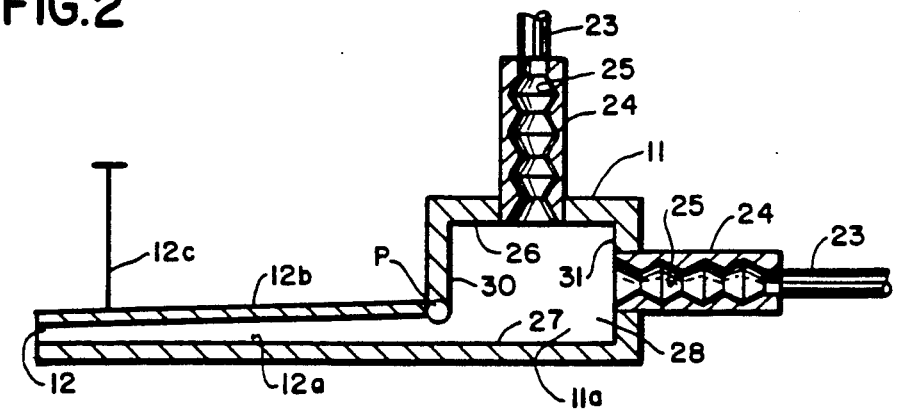
FIG. 2 is a detailed showing, on an enlarged scale and partly in section, of a portion of the apparatus seen in FIG. 1, and illustrating important structural features of the invention.
Figure 3:
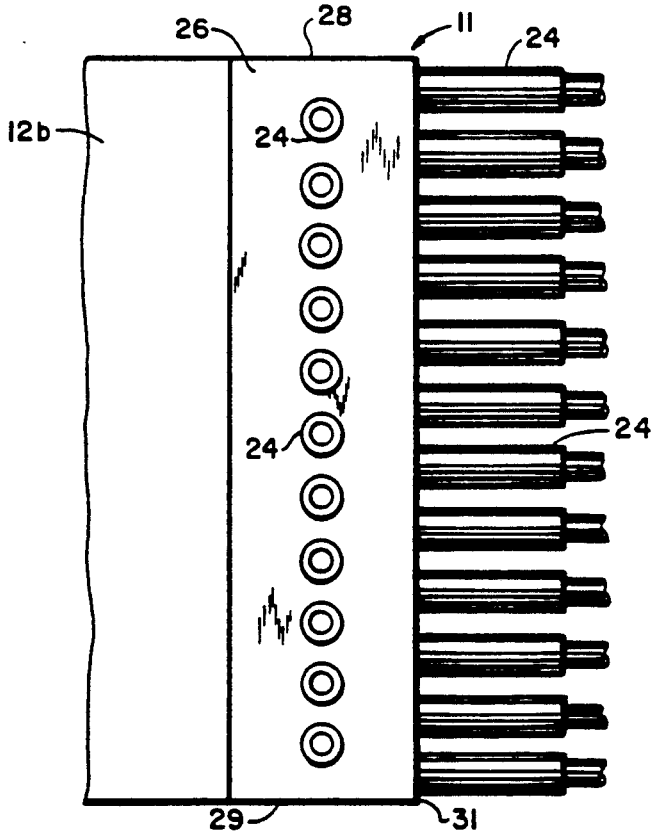
FIG. 3 is a top plan view of the portion of apparatus seen in FIG. 2.

In especial accordance with the present invention, and with reference also to FIGS. 2 and 3, improvement over the art resides in that manifold 23 leads to parallel arrays of foamable liquid-fiber furnish inlet nozzles 24 having tubular passages such as bores 25 of alternately increased and decreased cross-sectional areas. By such a bore configuration, the decreased cross sectional areas in combination with the increased cross sectional areas respectively effect alternate increases and decreases in the flow speed of the foamable furnish within the nozzles, thereby creating foam-forming turbulence. This same bore configuration is shear inducing, thereby lowering the apparent viscosity of the foam leaving the nozzles.

Further to the nozzles 24, they function as the sole foam forming devices in the present invention, and are disposed in direct fluid flow communication with the channel 11*a* of headbox 11 defined by substantially planar, generally parallel, relatively closely spaced upper and lower, horizontally extending wall portions 26 and 27, respectively, side wall portions 28 and 29, and front and rear wall portions 30 and 31, respectively. Construction and arrangement of the wall portions is such that the channel 11*a* has its major extent in a direction transverse the direction of forming wire movement.

The inlet connections of the one array of eleven nozzles 24 to the headbox extend through wall 26 in such a manner that foam-fiber furnish is directed from nozzles 24 at relatively low viscosity, transversely of the direction of extent of and onto a confronting, interior surface of wall portion 27 of headbox channel 11*a*. By such cooperative disposition, wall portion 27 serves as a turbulent flow inducing impact surface for the foam-fiber furnish. While the several walls or wall portions have been described and illustrated as being planar and parallel, it should be understood that they may be positioned out of parallel, or may be curved. For example, headbox channel 11*a* might be defined by a generally cylindrical wall portion.

The inlet connections of the other array of twelve nozzles 24 to the headbox extend through wall 31 to direct foam-fiber furnish onto confronting wall 30, which also functions as an impact surface extending transversely of the direction of entry of foam-fiber furnish from the one array of eleven nozzles 24. As is best seen in FIG. 3, the nozzles 24 further are arranged such that the nozzle axes of the one array are between and generally in a plane perpendicular to the general plane of the nozzle axes of the other array.

In a preferred embodiment, the axes of the eleven nozzles 24 of the one array are spaced along the headbox about two inches apart, as are similarly spaced the twelve nozzles of the other array; by this spacing, the headbox extends about two feet in the cross machine direction. Additional arrays or fractions thereof may be provided in accommodation of other machine widths. Each of nozzles 24 is about 3 inches in length and has a generally undulatory bore configuration defined by alternate convergent and divergent frustoconical sections. Generally, the narrower sections of lesser cross sectional area are about $\frac{1}{2}$ inch diameter, and the wider sections of greater cross sectional area are about $\frac{3}{4}$ inch diameter, with a distance between sections of about $\frac{1}{2}$ inch. The distance between the discharge end of each bore 25 and a confronting baffle or wall of channel 11*a* is about 2 inches. By such disposition of the nozzles the streams of foam-fiber furnish flowing from the nozzles at low viscosity impinge partially on one another and fully on the confronting impact surfaces or walls of the headbox channel at relatively short distances from the slice 12.

Since foam flowing from nozzles 24 is at its lowest apparent viscosity, a condition under which it is most likely to become turbulent, the abrupt changes of direction due to the hereinabove described impingements advantageously create considerable turbulence in channel 11*a* immediately prior to flow of the foam-fiber furnish through the relatively short throat 12*a* to slice 12 for uniform distribution onto forming wire 13. Throat 12*a* of slice 12 is about 16 inches long so that the foam with its dispersion of randomly oriented fibers advantageously travels a relatively short distance from the headbox channel through the slice throat, thereby minimizing unidirectional orientation as the foam tends to revert to laminar flow in the slice throat. Hence, apparatus embodying the invention achieves desirable, relatively low MD/CD ratios of fibrous webs with minimization of the number of moving parts.

In operation of the apparatus thus far described, a mixture of air, water, about 1.0 to 4.0% by weight of papermaking wood fibers, and from about 150 PPM to about 450 PPM of a surfactant are introduced to the mixer 20 in formation of a foamable furnish suitable for the manufacture of paper webs in the range of 8 to 30 pounds per ream (3,000 sq. ft.). While surfactant selection (e.g. anionic, nonionic, cationic, or amphoteric) is dependent upon the chemical make-up of other additives as may be used, such as, for example, bonding agents and the like, an anionic surfactant is suitable for use with the self-bonding wood fibers of the present disclosure. Any of the disclosed surfactants are available on the market, one such surfactant being alpha olefin sulphonate available from Arco Chemical Company under the trademark A-OK. By way of further example, U.S. Pat. Nos. 3,716,449, 3,871,952, and 4,056,456 disclose additional surfactants suitable for use in connection with the present invention, and their teachings are included herein by reference.

Further to operation of the apparatus, pump 21 withdraws the foamable furnish from mixer 20 and forces it through conduit 22 into manifold 23. The furnish is distributed through manifold 23 to each of nozzles 24 under a pressure of from about 25 to about 30 pounds per square inch. As the furnish is forced through the nozzles, it is foamed to a preferred consistency of from about 57% to about 65% air content with a bubble size from about 20 to about 200 microns in diameter. The foamed furnish is discharged into the headbox channel 11*a*, where it undergoes the desired fiber-deorienting turbulence, then flows through slice throat 12*a*, out slice 12, onto moving forming wire 13 at about 1.25 the speed of the wire. Some foam is caused to collapse as it is carried by wire 13 moving at a speed from about 1500 feet to about 3500 per minute over the suction boxes 15, 16, and the remaining foam along with liquid from the collapsed foam is drained through the wire 13 into the suction boxes under the influence of vacuum source 17. A pump 18 withdraws the foam and liquid from vacuum source 17 and directs it through conduit 19 back to mixer 20 for reuse. Air, as well as additional fiber, is supplied through conduit 33 from means designated generally by numeral 32.

An example of improvement in the MD/CD tensile strength ratio of a web, using our invention (RUN II), compared with the MD/CD tensile strength ratio of a web made using prior art teachings (RUN I), will be appreciated from the following tabulation, wherein percent air contents of the foam were held at about 67% and the mean velocity of foamed furnish flow at each point across the width of the slice was essentially a value of about 1.25 times the velocity of movement of the forming wire, which value is identified as the Efflux Ratio.

| RUN | BASIS WEIGHT | TENSILE STRENGTH MD | TENSILE STRENGTH CD | TENSILE STRENGTH RATIO MD/CD | % AIR | EFFLUX RATIO | WIRE SPEED (FPM) |
|---|---|---|---|---|---|---|---|
| I | 18.0 | 2536 | 319 | 7.95 | 67 | 1.25 | 1500 |
| II | 17.7 | 1361 | 467 | 2.91 | 67 | 1.25 | 1500 |

From the foregoing, it will be appreciated that the MD/CD tensile strength ratio of a foam-formed web can be reduced significantly using the present invention. It will be understood that adjustments, up or down, may be made on the MD/CD ratio by adjustments to the Efflux Ratio. For example, adjustments in the Efflux Ratio can be made to increase the MD/CD ratio, or vice versa, as seen in the following tabulation of Runs I, II, and III for Efflux Ratios of 1.25, 1.00 and 0.75:

| RUN | BASIS WEIGHT | TENSILE STRENGTH MD | TENSILE STRENGTH CD | TENSILE STRENGTH RATIO MD/CD | % AIR | EFFLUX RATIO | WIRE SPEED (FPM) |
|---|---|---|---|---|---|---|---|
| I | 17.7 | 1361 | 467 | 2.91 | 67 | 1.25 | 1500 |
| II | 17.3 | 1653 | 292 | 5.66 | 67 | 1.00 | 1500 |
| III | 17.3 | 1794 | 261 | 6.87 | 67 | 0.75 | 1500 |

In the additional, modified embodiments of the invention as seen in in FIGS. 4 to 6, the foam forming nozzles are in fluid flow communication with the headbox channel at different locations than those hereinabove described. In the additional, modified embodiment seen in FIG. 7, the headbox channel is generally cylindrical, affording curved walls as briefly described hereinabove, and the axes of the nozzles are located along the length of the channel as are the axes of the nozzles in FIGS. 1 to 3.

Figure 4:
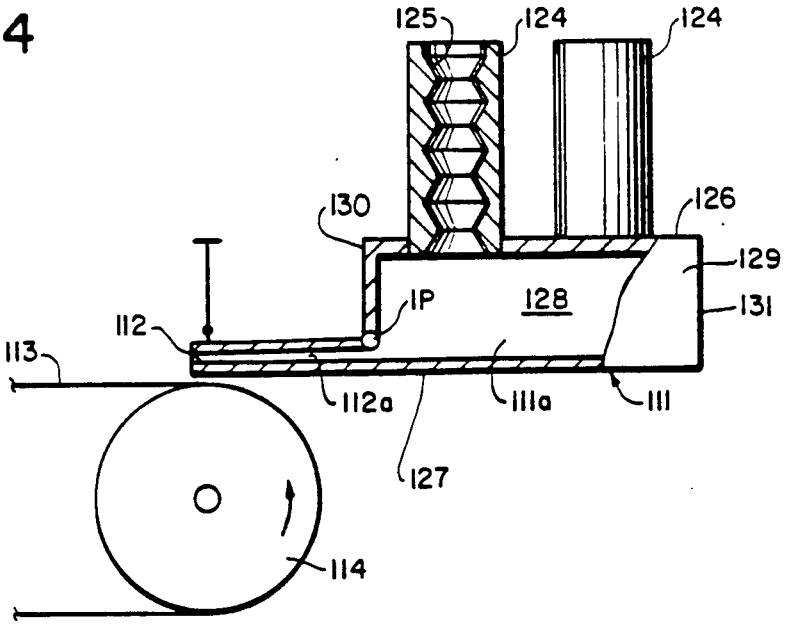
FIGS. 4 to 7 are showings similar to FIG. 2, and illustrating modified embodiments of the invention.

In FIG. 4, the several walls 126 through 131 of headbox 111, similar to the one described in connection with FIGS. 1 to 3, define a channel 111*a* leading to throat 112*a* for feeding foam-fiber furnish through adjustable slice 112 onto forming wire 113 moving on breast roll 114. Nozzles 124 are similar to the hereinabove described foam forming nozzles 24, and, while arranged in staggered array, are provided only in top wall 126, whereby foam-fiber furnish introduced into the channel impinges upon lower wall 127 as an impact surface.

Figure 5:
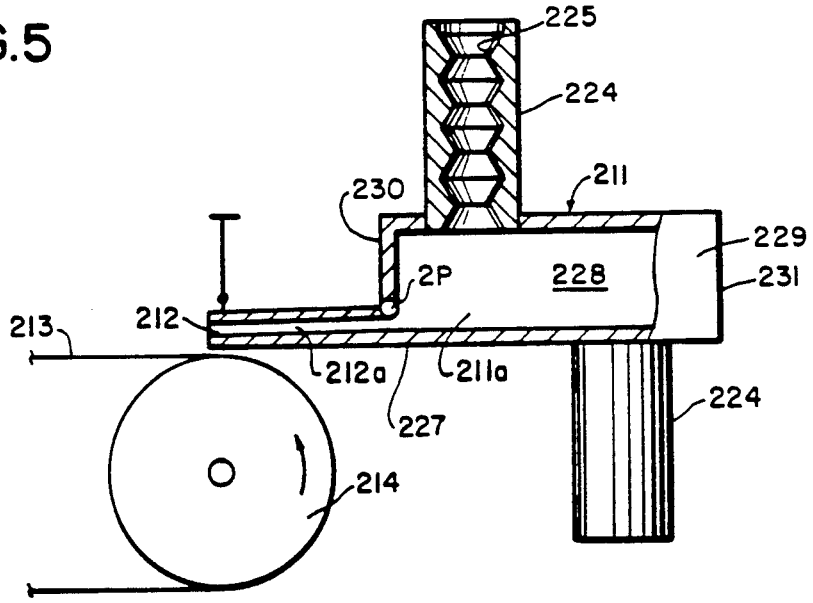

In FIG. 5, reference numerals refer to like numerals as seen in FIGS. 1, 2, or 3, but with the prefix 2 applied. It is seen that foam forming nozzles 224 are so positioned that one array is connected to the headbox channel 211*a* through top wall 226 and the other array is offset as respects the one array and is connected to the channel through bottom wall 227. In this construction the foam-fiber furnish introduced to the headbox channel through upper nozzles 224 impinges upon lower wall 227 and flows through throat 212*a*, while furnish introduced through lower nozzles 224 impinges on upper wall 226 and mingles with the furnish introduced through the upper nozzles as it flows through throat 212*a*.

Figure 6:
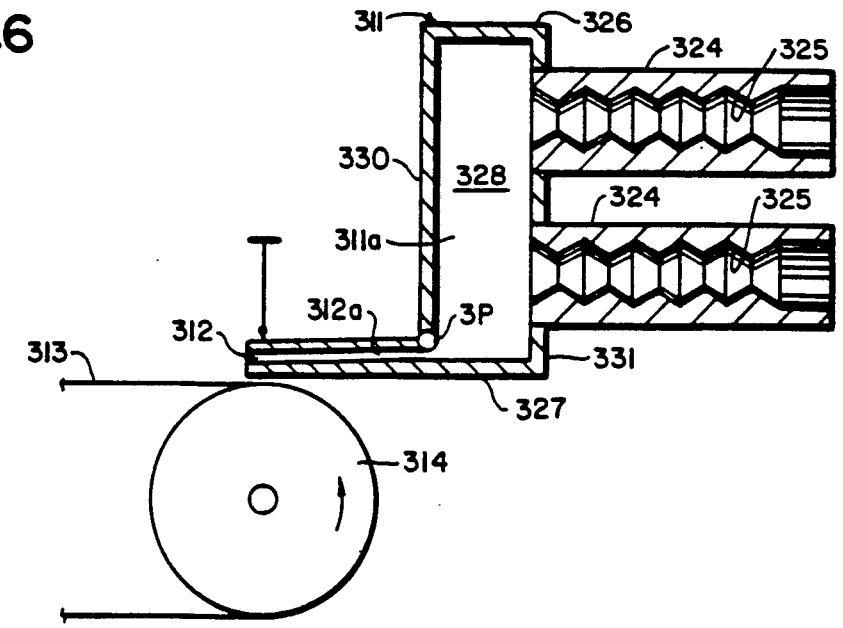

In FIG. 6, elements are designated with numerals used to designate like elements of FIGS. 1, 2, and 3, but with the prefix 3 applied, and it is seen that all nozzles 324 are connected to the headbox channel 311*a* through wall 331 for impingement of the foam fiber furnish onto opposite wall 330.

Figure 7:
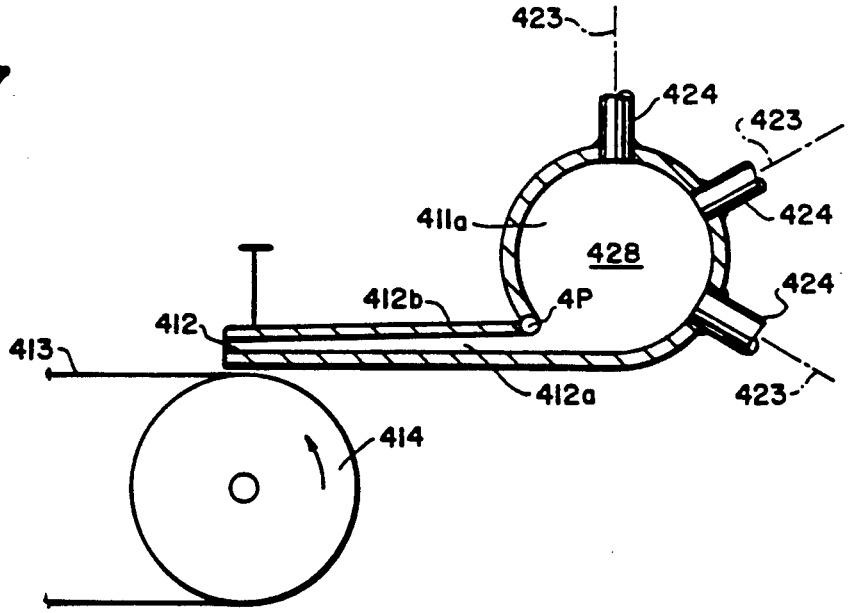

In FIG. 7, elements are designated with numerals used to designate like elements of FIGS. 1, 2, and 3, but with the prefix 4 applied. In FIG. 7, the horizontally extending headbox channel 411*a* is defined by curved wall portions of a hollow cylindrical structure about $2\frac{1}{4}$ inches in diameter and closed at its ends by walls, one of which is seen at 428. A cylindrical channel advantageously affords a compact arrangement for three arrays of foaming nozzles 424 of the type hereinabove described, and whose centerlines are spaced about $2\frac{1}{4}$ inches apart along the length of the channel. The arrays are disposed in fluid flow communication with channel 411 in upper left and right quadrants and in the lower right quadrant of the cylindrical wall of the channel so each nozzle is effective to direct foam-fiber furnish transversely of the polar axis of the cylindrical structure onto an opposed curved, cylindrical wall portion serving as an impact surface. The entrance of the slice throat 412*a* occupies the lower left quadrant. While the nozzles are shown in the same plane for the sake of convenience, it will be understood that the nozzles of each array are staggered as respects the nozzles of the other arrays, so that the spacing between centerlines of the nozzles as between arrays is about $\frac{3}{4}$ inch.

In any of the embodiments shown in FIGS. 1 to 6, the impact surface is relatively closely spaced from the region of introduction of the foaming nozzle to the relatively low-volume headbox channel, which impact surface also is substantially perpendicular to the axis of a nozzle. In the embodiment shown in FIG. 7, essentially the same spatial relationship exists, with the tangent to the cylindrical surface at the center of impact being substantially perpendicular to the axis of a nozzle. By such cooperative dispositions of the nozzles and impact surfaces, taken with a headbox channel of relatively small volume, turbulent foam flow is achieved throughout the channel and well into the slice throat. This turbulent flow advantageously maximizes random orientation of fibers well into the slice throat and as they exit the slice for deposition on the forming wire.

We claim:

1. In apparatus for the manufacture of a wet laid fibrous web, an improved headbox capable of producing a foam-fiber dispersion from an unfoamed feedstock comprising air and papermaking fibers dispersed in a foamable aqueous carrier medium comprising water and a surfactant and directing resulting foam-fiber furnish onto a forming wire which comprises a closed channel longitudinal headbox of rectangular cross section having parallel planar front and back walls and parallel planar top and bottom walls, a longitudinal outlet in the lowermost portion of said front wall for dispensing foam-fiber furnish through a slice or nozzle onto a forming wire, a first longitudinal array of fluid inlet nozzles uniformly spaced along the upper wall of said headbox channel for connection to a supply of pressurized feedstock arranged to forcibly discharge feedstock onto the bottom wall of said headbox along a vertical plane perpendicular thereto, and a second longitudinal array of fluid inlet nozzles uniformly spaced along the rear wall of said headbox channel for connection to a supply of pressurized feedstock arranged to forcibly discharge feedstock onto the front wall of said headbox along a plane parellel to the plane of said bottom wall thereof and perpendicular to the plane of said first array of nozzles in non-intersecting relationship with feedstock discharged from said first array to forcibly discharge feedstock onto the front wall of said headbox, thereby producing a foam-fiber furnish in said headbox immediately prior to its discharge through said outlet onto a forming wire.

2. Appratus according to claim 1 wherein the bore diameter of each of said nozzles is within the range of one half to three quarters inch, the spacing between nozzles in each array is about two inches, and the distance from the nozzle outlet to the impinging wall is about two inches.

3. Apparatus according to claim 2 wherein the bore of each nozzle is in the form of a series of alternate convergent and divergent passages providing alternately increasing and decreasing flow velocities of fluid passing therethrough and producing a high degree of turbulence in each nozzle just prior to discharge of said feedstock into said headbox.

* * * * *